US012486854B2

(12) United States Patent
Gu et al.

(10) Patent No.: US 12,486,854 B2
(45) Date of Patent: Dec. 2, 2025

(54) IMPELLER, DRAINAGE PUMP AND INDOOR UNIT OF AIR CONDITIONER

(71) Applicant: WELLING (WUHU) MOTOR MANUFACTURING CO., LTD., Anhui (CN)

(72) Inventors: Wenhai Gu, Anhui (CN); Zhengang Gao, Anhui (CN)

(73) Assignee: WELLING (WUHU) MOTOR MANUFACTURING CO., LTD., Anhui (CN)

( * ) Notice: Subject to any disclaimer, the term of this patent is extended or adjusted under 35 U.S.C. 154(b) by 0 days.

(21) Appl. No.: 18/135,478

(22) Filed: Apr. 17, 2023

(65) Prior Publication Data

US 2023/0250830 A1 Aug. 10, 2023

Related U.S. Application Data

(63) Continuation of application No. PCT/CN2020/136024, filed on Dec. 14, 2020.

(30) Foreign Application Priority Data

Nov. 12, 2020 (CN) ..... 202011262086.7
Nov. 12, 2020 (CN) ..... 202022619235.2

(51) Int. Cl.
*F04D 29/36* (2006.01)
*F04D 13/06* (2006.01)
(Continued)

(52) U.S. Cl.
CPC ..... *F04D 29/22* (2013.01); *F04D 13/06* (2013.01); *F04D 29/426* (2013.01)

(58) Field of Classification Search
CPC ..... F04D 13/06; F04D 29/007; F04D 29/02; F04D 29/22; F04D 29/2216;
(Continued)

(56) References Cited

U.S. PATENT DOCUMENTS

2017/0089354 A1* 3/2017 Shi ..... H02K 7/086
2017/0097008 A1* 4/2017 Doll ..... F04D 29/2266

FOREIGN PATENT DOCUMENTS

CN 1040252 A 3/1990
CN 1144305 A 3/1997
(Continued)

OTHER PUBLICATIONS

CN210106238U_MT, Machine Translation of CN210106238 (Year: 2020).*

(Continued)

*Primary Examiner* — Michael J Tsai
*Assistant Examiner* — Charles W Nichols
(74) *Attorney, Agent, or Firm* — Scully, Scott, Murphy & Presser, P.C.

(57) ABSTRACT

An impeller, a drainage pump, and an indoor unit of an air conditioner are provided. The impeller has an impeller shaft and a circular disc. Long blades are fixedly connected to the impeller shaft and extend outward along a radial direction of the impeller shaft. The circular disc has a plate-shaped structure sleeved on an outer circumference of the impeller shaft. The plate-shaped structure is provided with at least one balance through hole communicating front and rear sides of the plate-shaped structure.

19 Claims, 3 Drawing Sheets

(51) Int. Cl.

| | |
|---|---|
| ***F04D 25/06*** | (2006.01) |
| ***F04D 29/22*** | (2006.01) |
| ***F04D 29/32*** | (2006.01) |
| ***F04D 29/42*** | (2006.01) |
| ***F21V 33/00*** | (2006.01) |

(58) Field of Classification Search
CPC .. F04D 29/2222; F04D 29/2227; F04D 29/24; F04D 29/242; F04D 7/02; F04D 29/2266; F04D 29/426; F24F 13/222
See application file for complete search history.

(56) References Cited

FOREIGN PATENT DOCUMENTS

| | | | | |
|---|---|---|---|---|
| CN | 1804403 | A | | 7/2006 |
| CN | 101126388 | A | | 2/2008 |
| CN | 201246329 | | | 5/2009 |
| CN | 101943181 | A | | 1/2011 |
| CN | 20231871 | U | | 11/2011 |
| CN | 202170891 | U | | 3/2012 |
| CN | 202381391 | | | 8/2012 |
| CN | 202431599 | | | 9/2012 |
| CN | 203604254 | | | 5/2014 |
| CN | 106837853 | A | | 6/2017 |
| CN | 210106238 | U | * | 2/2020 |
| CN | 111852936 | | | 10/2020 |
| CN | 213511344 | U | | 6/2021 |
| JP | 2002242885 | A | * | 8/2002 |
| JP | 2010007909 | | | 1/2010 |
| TW | 1704289 | | | 9/2020 |

OTHER PUBLICATIONS

JP2002242885A_MT, Machine Translation of JP2002242885 (Year: 2002).*
Supplementary European Search Report dated Feb. 13, 2024 received in European Patent Application No. EP 20961399.1.
International Search Report dated Aug. 10, 2021 issued in PCT/CN2020/136024.
Notice of the First Review Opinion dated Nov. 15, 2024, received in Chinese Application No. 202011262086.7.
Rejection Decision dated Apr. 10, 2025 received in Chinese Patent Application No. 202011262086.7.
Review Notice dated Sep. 15, 2025 received in Chinese patent Application No. 202011262086.7.
First office Action dated Sep. 18, 2025 received in Chinese patent Application No. 202310871244.6.
First office Action dated Sep. 18, 2025 received in Chinese patent Application No. 202310868069.5.

* cited by examiner

IMPELLER, DRAINAGE PUMP AND INDOOR UNIT OF AIR CONDITIONER

CROSS REFERENCE TO RELATED APPLICATIONS

The present application is a continuation application of PCT International Patent Application No. PCT/CN2020/136024 filed on Dec. 14, 2020, which claims priority to and benefits of Chinese Patent Application No. 202011262086.7 filed on Nov. 12, 2020 and Chinese Patent Application No. 202022619235.2 filed on Nov. 12, 2020. The entire contents of each of the aforementioned applications, including any intervening amendments thereto, are incorporated herein by reference for all purposes. No new matter has been introduced.

FIELD

The present application relates to the field of refrigeration devices, and more particularly to an impeller, a drainage pump and an indoor unit of an air conditioner.

BACKGROUND

When an indoor unit of an air conditioner is implementing the refrigeration operation, the moisture in the air will be condensed on the surface of the heat exchanger when it is cold, and then the condensed water drops into the condensate tray arranged under the heat exchanger. In order to drain the condensed water accumulated in the condensate tray, a drainage pump is usually mounted at the condensate tray of the indoor unit of the air conditioner. On the premise of meeting the specified flow and head, such drainage pump also needs to ensure that the working noise is limited within the specified range to meet the strict requirements of the air conditioning system for controlling noise.

The impeller is an important part of the drainage pump, the impeller is driven by the motor to rotate during operation, such that a vacuum is generated in the middle of the impeller, and the water is sucked into the impeller, and then the water is discharged through high-speed rotation. When the water level in the condensate tray of the existing drainage pump is lower, the water and air are sucked into the drainage pump at the same time, and the water and steam mixture state of half water and half steam is formed in the impeller. The water distributed in the impeller is uneven, which results in unbalanced vibration, and the working noise of the drainage pump is larger, and the working noise brings great trouble to users. With the increasing demand on quality of life, how to reduce the working noise of the drainage pump has become a problem that needs to be solved urgently.

SUMMARY

One object of exemplary embodiments of the present application is to at least provide an impeller, a drainage pump, and an indoor unit of an air conditioner, in order to at least solve the technical problem that the noise generated during the operation of the drainage pump in the art is significant.

In order to solve above technical problem, the technical solution adopted in embodiments of the present application is as following:

In a first aspect, an impeller is provided, and the impeller includes: an impeller shaft; long blades, fixedly connected to the impeller shaft and extending outward along a radial direction of the impeller shaft; a circular disc, including a plate-shaped structure sleeved on an outer circumference of the impeller shaft, the plate-shaped structure is provided with at least one balance through hole communicating front and rear sides of the plate-shaped structure.

The impeller includes at least one balance through hole on the plate-shaped structure, so that when the water and air are sucked into the impeller cavity at the same time, the air can be discharged out of the cavity through the at least one balance through hole to balance the pressure difference between the inner cavity and the outer cavity of the impeller, the axial force is reduced, thus the vibration caused by the pressure difference during the operation of the impeller is reduced, and the noise generated during the operation of the impeller is reduced.

In addition, a plurality of balance through holes can be provided. The balance through holes are arranged on the plate-shaped structure, and the bottoms of the long blades are fixed on the plate-shaped structure, so that the water throwing direction of the long blades are perpendicular to the axis direction of the balance through holes, and the water thrown out by the long blades cannot directly enter the balance through holes, which will not generate the whistling sound caused by the gas-liquid mixture rapidly passing through the aperture or slot, which is conducive to further reducing the noise generated during the operation of the impeller.

In an embodiment, a connection hole is provided at the top of the impeller shaft, thus facilitating the fixed connection of the impeller and the output shaft of the motor.

For example, the impeller shaft and the output shaft of the motor can be connected by splines. For example, an inner spline can be arranged in the connection hole, and the outer spline can be arranged on the outer wall of the output shaft of the motor. The output shaft of the motor extends into the connection hole to make the inner spline and the outer spline fixedly connected, so as to implement the transmission connection between the output shaft of the motor and the impeller shaft.

In an embodiment, a plurality of long blades are arranged to be evenly distributed or equally spaced on the outer peripheral wall of the impeller shaft. In an embodiment, four long blades are provided to form a cross-shaped structure and the included angle between any two adjacent long blades is 90 degrees.

In an embodiment, the number of the long blades can be varied, which is not limited in the present application.

In one possible embodiment, the plurality of holes are evenly arranged at the outer edge of the plate-shaped structure. The bubbles in the impeller cavity move with the water flow. Under the action of the long blades, the water flow near the outer edge of the plate-shaped structure is faster and the bubbles are easier to be discharged. Therefore, the balance through holes arranged at the outer edge of the plate-shaped structure can improve the air discharge efficiency, which is conducive to reducing the noise generated during the operation of the impeller.

In an embodiment, the balance through holes are arranged between two adjacent blades.

In a possible embodiment, the balanced through holes are round holes with an aperture in a range of 1.0~3.0 mm, for example, 1.5 mm, 1.8 mm, 2.0 mm, 2.3 mm, 2.5 mm, 2.8 mm, etc. The aperture of the balance through holes being too large or too small is not suitable. The aperture being too large will easily reduce the suction of the impeller, which will reduce the head and water discharge of the drainage pump. However, if the aperture is too small, the air discharge effect (i.e., the air pressure balance effect) will not be obvious. In the present application, the aperture of the balance through holes can be provided according to the water flow rate. The larger the flow rate, the larger the aperture can be provided. The balance through holes are arranged at the outer edge of the plate-shaped structure, and the selection range of the aperture can be 1.0~3.0 mm.

Optionally, in other embodiments, the sectional shape of the balance through holes can be elliptical, rectangular, triangular, rhombic, trapezoidal or waist-shaped, etc. which is not limited in the present application.

In an embodiment, the size and shape of each balancing through hole can be the same or different, which is not limited in the present application.

In an embodiment, the aperture of each balance through hole in the axial direction can be the same or different, which is not limited in the present application. For example, the apertures of the balance through holes can gradually increase or decrease along the direction of the front side of the plate-shaped structure in the axial direction.

In other embodiments, the plurality of balanced through holes can also be arranged in other positions (such as, the middle) of the plate-shaped structure and arranged in other ways (such as non-even arrangement), which is not limited in the present application.

In a possible embodiment, the circular disc further includes an annular structure fixedly connected with the outer edge of the plate-shaped structure, the annular structure is arranged at outer circumferences of the long blades, and a gap is formed between the circular disc and each of the long blades.

The annular structure surrounds the long blades, such that the water discharged by the impeller (i.e. the water thrown by the blades) is blocked by the annular structure to reduce the flow rate before hitting the inner wall of the pump housing to generate noise, thus facilitating to reduce the noise generated during the operation of the impeller. In addition, there is a gap between the annular structure and each of the outer ends of the long blades. With the above structural improvement, the water flow can be further interfered, so that more water will first be blocked by the annular structure to slow down, rather than directly thrown onto the inner wall of the pump housing, which is conducive to further reducing the noise generated during the operation of the impeller, such that the noise reduction effect of the impeller provided in the present application is improved.

In an embodiment, the gap is arranged between 1 mm to 2 mm. For example, which can be 1.2 mm, 1.5 mm or 1.8 mm.

In an embodiment, the size of the gap formed between a plurality of long blades and the annular structure can be the same or different, which is not limited in the present application.

In a possible embodiment, a height of the annular structure is higher than a height of the long blades along the axial direction of the impeller shaft. The upper end of the annular structure is higher than the upper end of the long blades, so as to ensure that the impeller has sufficient suction, and thus ensure that the drainage pump has sufficient drainage capacity.

In a possible embodiment, at least one short blade is arranged on the plate-shaped structure and located between the two adjacent long blades.

In a possible embodiment, each of the balance through holes is arranged between two adjacent blades, and a gap is formed between each of the balance through holes and the annular structure. With the above arrangement, the air discharge efficiency can be improved, which can ensure that the air will not be discharged from the side of the impeller. Thus, the noise generated during the operation of the impeller can be reduced, and the user experience can be improved.

In a possible embodiment, a gap is formed between each of outer ends of the short blades and the annular structure.

In an embodiment, the size of the gap formed between a plurality of short blades and the annular structure can be the same or different, which is not limited in the present application.

In an embodiment, the size of the gap formed between the short blades and the long blades and the annular structure can be the same or different, which is not limited in the present application.

For example, a plurality of short blades can be provided between the two adjacent long blades, which are in the plate-shaped, and the length can be the same or different.

In an embodiment, the height of the short blades is the same as that of the long blades.

In an embodiment, the top of the short blades can also be higher or lower than the top of the long blades.

In a possible embodiment, the plate-shaped structure gradually extends in an obliquely upward direction from a center to an outside in a direction towards the long blade. With above arrangement, the plate-shaped structure can form a "funnel" structure as a whole, which can play a better role in pushing and guiding the water flow, thus preventing the water flow from falling back after lifting, and the water flow can be lifted smoothly, which is conducive to reducing noise.

In a possible embodiment, the plate-shaped structure is fixedly connected with bottoms of the long blades.

In a possible embodiment, an end of the impeller shaft facing away from the long blades is further provided with drainage blades, and the drainage blades are connected with the long blades one by one, and a length of each of the long blades in the radial direction of the impeller shaft is greater than a length of each of the drainage blades.

In an embodiment, a number of the drainage blades is the same as that of the long blades, the number can be 4, and the overall shape of the drainage blades is a cross.

During use, the drainage blades are immersed in water with the suction port of the drainage pump, and the agitation of the drainage blades will lift the water into the inner cavity of the impeller. In order to improve the drainage effect, the width of the drainage blades in the direction of water flow can be gradually increased, and the overall shape of the drainage blades is smooth transition.

In a possible embodiment, the impeller is integrally molded by an injection molding process, which is conductive to improve the overall mechanical strength of the impeller.

In an embodiment, the impeller can also be made through other integrated molding. For example, the impeller can be made of a metal member, which can form an integrated structure through forging and other processes.

In a second aspect, a drainage pump is provided, which includes a pump housing, a motor, and an impeller provided according to any of the possible embodiments of above first aspect. The impeller can be movably accommodated in the pump housing, and the output shaft of the motor is fixedly connected with the impeller shaft.

In a possible embodiment, the pump housing is respectively provided with a suction port and a drainage port. The motor drives the impeller to rotate. Under the action of centrifugal force, the water is sucked into the pump housing through the suction port, and then discharged through the drainage port.

In a possible embodiment, the drainage pump further includes a power line, which is connected with the motor to supply power to the motor.

In an embodiment, the motor is a single-phase permanent magnet synchronous motor. Further, the motor can include a stator, a rotor and an output shaft of the motor.

During the operation of the drainage pump, the stator drives the rotor to rotate, and drives the impeller to rotate through the output shaft of the motor and impeller shaft. The water is sucked into the pump housing through the suction port, and finally discharged through the drainage port. Since the structure of the impeller of the present application is optimized, the internal and external pressure difference of the impeller is balanced, the vibration of the impeller during operation is reduced, and the noise generated during the operation of the impeller is reduced.

In an embodiment, the pump housing is made of a plastic material, which is conducive to reducing the overall weight of the drainage pump.

In an embodiment, the pump housing can include an upper pump housing and a lower pump housing. The upper pump housing and the lower pump housing form a detachable connection into an integral structure through screws, clips, etc., thus defining the accommodating cavity of the drainage pump, and the impeller is accommodated in the accommodating cavity.

Further, the motor is further arranged in the accommodating cavity.

In other embodiments, the motor can further be arranged outside the accommodating cavity, and the output shaft of the motor extends into the accommodating cavity from the outside of the pump housing and is fixedly connected with the impeller shaft.

Since the drainage pump adopts the impeller provided by the above embodiments, the drainage pump also has the technical effect corresponding to the aforementioned impeller, which will not be repeated here.

In the third aspect, an indoor unit of an air conditioner is provided, including a condensate tray and the drainage pump provided in the second aspect, the suction port of the drainage pump is in communicated with the condensate tray, so that the drainage pump can discharge the condensate collected by the condensate pump.

Since the indoor unit of the air conditioner adopts the impeller provided by the above embodiments, the indoor unit also has the technical effect corresponding to the aforementioned impeller, which will not be repeated here.

The beneficial effects of the impeller, the drainage pump and the indoor unit of the air conditioner provided by embodiments of the present application include but are not limited to the following: the impeller provided in the present application is provided by providing at least one balance through hole on the plate-shaped structure, so that when the water and air are sucked into the impeller cavity at the same time, the air can be discharged out of the cavity through the balance through holes to balance the pressure difference between the inner cavity and the outer cavity of the impeller, the axial force is reduced, thus the vibration caused by the pressure difference during the operation of the impeller is reduced, and the noise generated during the operation of the impeller is reduced.

In addition, the balance through holes of the present application are arranged on the plate-shaped structure, and the bottoms of the long blades are fixed on the plate-shaped structure, so that the water throwing direction of the long blades are perpendicular to the axis direction of the balance through holes, and the water thrown out by the long blades cannot directly enter the balance through holes, which will not generate the whistling sound caused by the gas-liquid mixture rapidly passing through the aperture or slot, which is conducive to further reducing the noise generated during the operation of the impeller.

Since the drainage pump adopts the impeller provided by the above embodiments, the drainage pump also has the technical effect corresponding to the aforementioned impeller, which will not be repeated here.

Since the indoor unit of the air conditioner adopts the impeller provided by the above embodiments, the indoor unit also has the technical effect corresponding to the aforementioned impeller, which will not be repeated here.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

Figure 1:
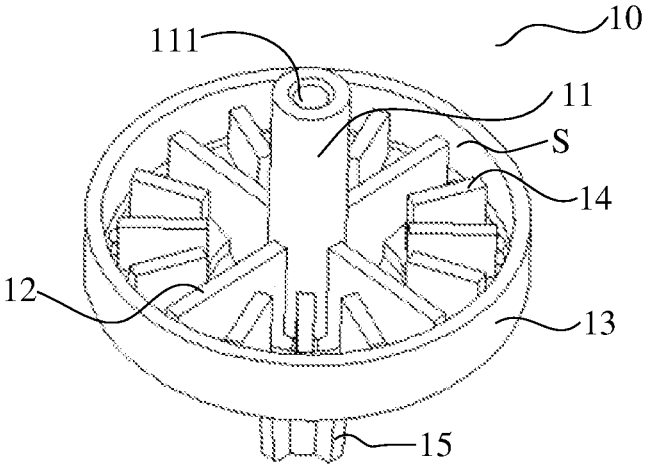
FIG. 1 is a schematic view of an overall structure of an impeller from a perspective provided by an embodiment of the present application.

The reference numerals shown in the drawings are described as follows:

10—impeller; 11—impeller shaft; 111—connection hole; 12—long blade; 13—circular disc; 131—plate-shaped structure; 132—annular structure; 14—short blade; 15—drainage blade; 16—balance through hole; 17—inlet through hole; 20—pump housing; 30—motor; 40—suction port; 50—drainage port; 60—power line; 100—drainage pump; 200—condensate tray; 1000—indoor unit of air conditioner.

DETAILED DESCRIPTION OF EMBODIMENTS

The technical solution in the present application will be described below in combination with the attached drawings. Obviously, the described embodiments are only part of the embodiments of the present application, not all of them.

In the description of the present application, it should be noted that unless otherwise specified and limited, the terms "mounting", "connected" and "connecting" should be understood in a broad sense, for example, which can be fixed connection, detachable connection, or integrated connection; it can be mechanical connection, electrical connection or mutual communication; it can be directly connected, or indirectly connected through intermediate media, or it can be the internal connection of two components or the interaction between two components. For those skilled in the art, the specific meaning of the above terms in the present application can be understood according to the specific situation.

In the description of the present application, it is necessary to understand that the orientation or position relationship indicated by the terms "up", "down", "side", "inside", "outside", "top", "bottom", etc. is based on the installation orientation or position relationship, which is only for the convenience of describing the present application and simplifying the description, rather than indicating or implying that the device or element referred to must have a specific orientation, be constructed and operated in a specific orientation, Therefore, it cannot be understood as a restriction on the present application.

It should also be noted that in the embodiment of the present application, the same reference sign is used to represent the same component or the same part. For the same parts and components in the embodiment of the present application, the reference sign may only be used for one of the parts or components. It should be understood that the reference signs are also applicable to other identical parts or components.

Figure 2:
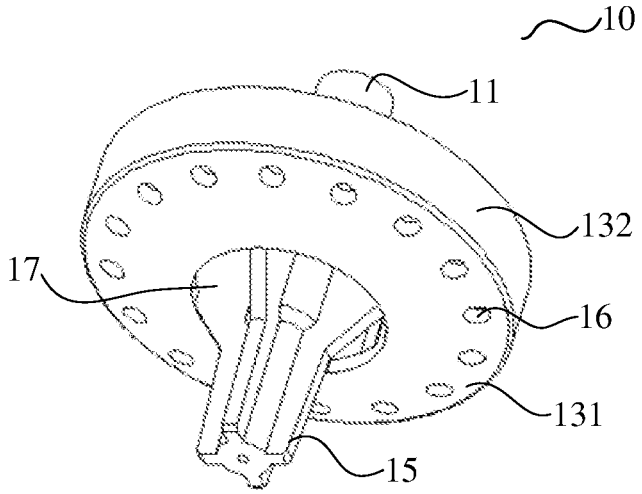
FIG. 2 is a schematic view of an overall structure of an impeller from another perspective provided by an embodiment of the present application.
Figure 3:
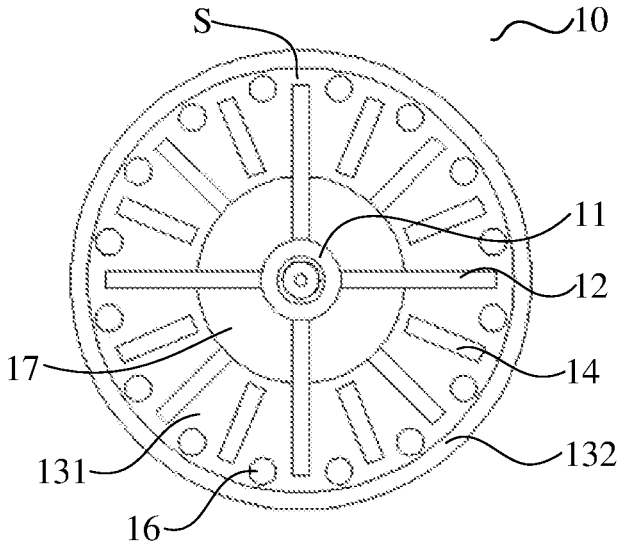
FIG. 3 is a top view of an impeller provided by an embodiment of the present application.
Figure 4:
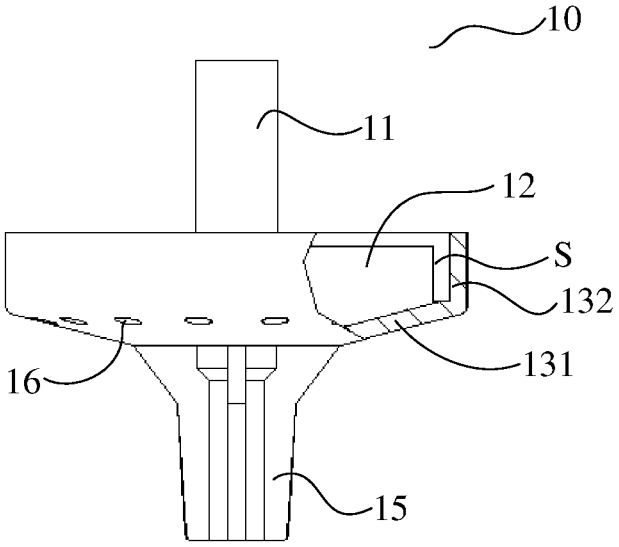
FIG. 4 is a partial sectional view of an impeller provided by an embodiment of the present application.

In a first aspect, an embodiment of the present application provides an impeller 10, and the impeller 10 can be applied to a drainage pump. FIG. 1 is a schematic view of an overall structure of the impeller 10 from a perspective provided by the embodiment of the present application. FIG. 2 is a schematic view of an overall structure of the impeller 10 from another perspective provided by the embodiment of the present application. FIG. 3 is a top view of the impeller 10 provided by the embodiment of the present application. FIG. 4 is a partial sectional view of the impeller 10 provided by the embodiment of the present application.

As shown in FIGS. 1 to 4, the impeller 10 provided by the embodiment of the present application includes: an impeller shaft 11, long blades 12 and a circular disc 13.

The impeller shaft 11 is used for fixed connection with the output shaft of the motor of the drainage pump, and the motor drives the entire impeller 10 through the impeller shaft 11 to rotate, so that water can be sucked into the drainage pump.

In an embodiment, as shown in FIG. 1, a connection hole 111 is provided at a top of the impeller shaft 11, which facilitates the fixed connection of the impeller 10 and the output shaft of the motor.

For example, impeller shaft 11 and output shaft of the motor can be connected by splines. In an embodiment, an inner spline can be arranged in the connection hole 111, and an outer spline can be arranged on the outer wall of the output shaft of the motor. The output shaft of the motor extends into the connection hole 111 such that the inner spline and the outer spline are fixedly connected, so as to realize the transmission connection between the output shaft of the motor and the impeller shaft 11.

In other embodiments, the output shaft of the motor is further connected to the impeller shaft 11 by other means, and the output shaft of the motor is directly connected to the impeller shaft 11 or indirectly connected through the intermediate medium, which is not limited in the present application.

The long blades 12 are in plate shape, one ends of the long blades are fixedly connected to the impeller shaft 11, and the other ends of the long blade extend radially from the impeller shaft 11. That is, the long blades 12 extend outward along the radial direction of the impeller shaft 11, and the long blades 12 are arranged radially with the axis of the impeller shaft 11 as the center. The long blades 12 are rotated under the driving of the impeller shaft 11 to generate suction, so that water can be sucked into the inner cavity of the drainage pump and further thrown out of the inner cavity of the impeller 10.

A plurality of long blades 12 are provided and evenly arranged around the outer circumference of the impeller shaft 11, and an included angle between the two adjacent long blades 12 can be the same. As shown in FIGS. 1 and 3, in an embodiment of the present application, four long blades 12 are provided, and the four long blades 12 are arranged evenly around the outer circumference of the impeller shaft 11, and the included angle between the two adjacent long blades 12 is 90 degrees. In an embodiment, the four long blades 12 are arranged in a "cross" shape.

In other embodiments, the long blades 12 are provided with more or fewer, which is not limited in the present application. For example, three, five or six long blades 12 are provided, where the long blades 12 are arranged evenly around the outer circumference of the impeller shaft 11, and the included angles between the two adjacent long blades 12 can be 120 degrees, 72 degrees or 60 degrees.

The circular disc 13 is sleeved on the outer circumference of the impeller shaft 11, and the circular disc 13 includes a plate-shaped structure 131 fixedly connected with the bottoms of the long blades 12. The long blades 12 are vertically arranged on the plate-shaped structure 131, and the plate-shaped structure 131 can provide support for the long blades 12. Thus, the mechanical strength of the impeller is improved.

The plate-shaped structure 131 is sleeved on the outer circumference of the impeller shaft 11. The plate-shaped structure 131 and the long blades 12 are arranged along the axis direction of the impeller shaft in turn, and the long blades 12 are fixedly connected with the plate-shaped structure 131.

The plate-shaped structure 131 is provided with at least one balance through hole 16 communicating the inside and outside of the circular disc 13. For example, in an embodiment, the balance through hole 16 is provided with only one; in another embodiment, the balance through holes 16 can be 2, 3, 6, 8 or more.

The balance through holes 16 communicate the front and rear sides of the plate-shaped structure 131. In other words, the balance through holes 16 communicate the inside and outside of the impeller 10, so that the air pressure on the inside and outside of the impeller 10 are balanced.

The impeller 10 provided by the embodiment of the present application is provided with at least one balance through hole 16 in the plate-shaped structure 131. In this way, when water and air are sucked into the impeller cavity together (for example, from the inlet through hole 17 to be introduced later), the air can be discharged out of the cavity through the balance through holes 16, which can balance the pressure difference between the inner and outer cavities of the impeller 10 and reduce the axial force. Therefore, the vibration caused by the pressure difference during the operation of the impeller 10 is reduced, so as to further reduce the noise generated during the operation of the impeller 10.

In addition, the balance through holes 16 of the present application is arranged on the plate-shaped structure 131, and the bottoms of the long blades 12 are fixed on the plate-shaped structure 131, so that the water throwing direction of the long blades 12 is perpendicular to the axis direction of the balance through holes 16, and the water thrown out by the long blades 12 cannot directly enter the balance through holes 16, so that the whistling sound generated by the gas-liquid mixture rapidly passing through the aperture or slot will not be generated, which is conductive to further reduce the noise generated during the operation of the impeller 10.

In an embodiment, the balance through holes 16 are arranged between the long blades 12. That is, the positions (where the balance through holes 16 are located) avoid the long blades 12 and are not intersected or penetrated the long blades 12, so as to improve the air discharge efficiency. Thus, the noise generated during the operation of the impeller 10 is reduced, and the user experience is improved.

In an embodiment, a plurality of balance through holes 16 are provided, and the plurality of balance through holes 16 are evenly arranged or equally spaced at the outer edge of the plate-shaped structure 131. The bubbles in the cavity of impeller 10 move with the water flow. Under the action of the long blades 12, the water flow near the outer edge is faster and the bubbles are easier to be discharged. Therefore, the balance through holes 16 being arranged at the outer edge of the plate-shaped structure 131 can improve the air discharge efficiency and further conductive to reduce the noise generated during the operation of the impeller 10.

In an embodiment, as shown in FIGS. 2 to 4, the balanced through holes 16 are circular holes with an aperture in a range of 1.0~3.0 mm, for example, 1.5 mm, 1.8 mm, 2.0 mm, 2.3 mm, 2.5 mm or 2.8 mm, etc. The aperture of the balance through hole 16 being too large or too small is not suitable. The balance through holes 16 with too large aperture can easily reduce the suction of the impeller 10, which will reduce the head and displacement of the drainage pump. However, if the aperture of balance through holes 16 are too small, the air discharge effect (i.e., the air pressure balance effect) is not obvious. In the embodiment of the present application, the aperture of the balance through holes 16 is arranged according to the water flow rate. The larger the flow rate, the larger the aperture can be provided. The balance through holes 16 are provided at the outer edge of the plate-shaped structure 131, and the selection range of the aperture is 1.0~3.0 mm.

In other embodiments, the sectional shape of each balance through hole 16 is elliptical, rectangular, triangular, rhombic, trapezoidal, or waist-shaped, which is not limited in the present application.

In an embodiment, the size and shape of each balance through hole 16 is the same or different, which is not limited in the present application.

In an embodiment, the aperture of each balance through hole 16 in the axial direction is the same or different, which is not limited in the present application. For example, the apertures of the balance through holes 16 are gradually increased or decreased in axial direction along the direction toward the front side of the plate-shaped structure.

In other embodiments, a plurality of balanced through holes 16 are arranged in other positions (such as the middle) of the plate-shaped structure 131, and arranged in other ways (such as non-equal arrangement), which is not limited in the present application.

As shown in FIGS. 1 to 4, in the embodiment of the present application, the circular disc 13 further includes an annular structure 132 fixedly connected with the outer edge of the plate-shaped structure 131. The annular structure 132 is arranged on the outer circumference of the long blades 12 and a gap S is formed between the annular structure 132 and each of the outer ends of the long blades 12.

The annular structure 132 surrounds the long blades 12, such that the water discharged from the impeller 10 (that is, the water thrown out by the blade) is blocked by the annular structure 132 to reduce the flow rate before hitting the inner wall of the pump housing to generate noise, thus conductive to reduce the noise generated during the operation of the impeller 10. In addition, the gap S is formed between the annular structure 132 and each of the outer ends of the long blades 12. Through the above structural improvement, the water flow can be further interfered, so that more water will first be blocked by the annular structure 132 to slow down, rather than directly thrown onto the inner wall of the pump casing, which is conducive to further reducing the noise generated during the operation of the impeller 10, such that the noise reduction effect of the impeller 10 provided in the present application is obvious.

In an embodiment, the gap S is ranged from 1 to 2 mm. For example, the gap S can be 1.2 mm, 1.5 mm or 1.8 mm.

In an embodiment, the size of the gap formed between a plurality of long blades 12 and the annular structure 132 is the same or different, which is not limited in the present application.

As shown in FIG. 4, in the embodiment of the present application, the upper end of the annular structure 132 is higher than the upper ends of the long blades 12 along the axial direction of the impeller shaft 11, which can ensure that the impeller 10 has sufficient suction and thus ensure that the drainage pump has sufficient drainage capacity.

As shown in FIGS. 1 and 3, at least one short blade 14 is arranged on the plate-shaped structure 131 and located between the two adjacent long blades 12, and a gap is formed between each of the outer ends of the short blades 14 (i.e., the end far away from the impeller shaft 11) and the annular structure 132.

The length of the short blade 14 is smaller than the long blade 12. The short blades 14 are arranged radially and extend outward along the radial direction of the impeller shaft 11, and the bottoms of the short blades are fixedly connected with the plate-shaped structure 131. The short blades 14 are perpendicular to the plate-shaped structure 131. Similar to the long blades 12, a gap is further formed between each of the outer ends of the short blades 14 and the annular structure 132, which can further reduce the noise generated during the operation of the impeller 10.

In an embodiment of the present application, three short blades 14 are arranged between two adjacent long blades 12. The length of each short blade 14 is the same or different, which is not limited in the present application.

In an embodiment, the size of the gap formed between a plurality of short blades 14 and the annular structure 132 is the same or different, which is not limited in the present application.

In an embodiment, the size of the gap formed between the short blades 14 and the long blades 12 and the annular structure 132 is the same or different, which is not limited in the present application.

In other embodiments, more or less short blades 14 are provided between two adjacent long blades 12. For example, one, two, and four short blades 14 can be provided between two adjacent long blades 12, which is not limited in the present application.

In an embodiment of the present application, the balance through holes 16 are provided between two adjacent blades. For example, the balance through holes are provided between the adjacent long blade 12 and short blade 14, and provided between the adjacent two short blades 14.

In an embodiment, the positions where the balance through holes 16 are located avoid the long blades 12, the short blades 14, and the annular structure 132, and are not intersected or penetrated the long blades 12, the short blades 14, and the annular structure 132, that is, the gaps are formed between the hole walls of the balance through holes 16 and the inner wall of the annular structure 132, which can ensure that the air will not be discharged from the side of the impeller 10 while improving the air discharge efficiency, and is conducive to reducing the noise generated during the operation of the impeller 10, and the user experience is improved.

Similarly, in an embodiment of the present application, the upper end of the annular structure 132 is higher than the upper ends of the short blades 14, which can ensure that the impeller 10 has sufficient suction, and thus ensure that the drainage pump has sufficient drainage capacity.

In an embodiment, the short blades 14 are of the same height as the long blades 12.

In other embodiments, the top of the short blade 14 is higher or lower than the top of the long blade 12.

As shown in FIGS. 2 and 3, the central part of the plate-shaped structure 131 is provided with an inlet through hole 17, and the impeller shaft 11 passes through the inlet through hole 17, and the aperture of the inlet through hole 17 is larger than the aperture of the impeller shaft 11.

The aperture of the inlet through hole 17 is larger than the shaft diameter of the impeller shaft 11, so that the water can pass through the gap formed between the hole wall of the inlet through hole 17 and the outer wall of the impeller shaft 11 and enter the inner cavity of the impeller 10.

As shown in FIGS. 1, 2 and 4, the bottom of the impeller shaft 11 is further fixedly connected with the drainage blades 15, which are correspondingly connected with the long blades 12 in the same direction, and the length of the long blade 12 in the radial direction is greater than that of the drainage blade 15.

In other words, the end of the impeller shaft 11 facing away from the long blades 12 is further provided with at least one drainage blade 15, the drainage blades 15 are arranged to space apart along the circumference of the impeller shaft 11, and each drainage blade 15 is connected with each long blade 12 one by one.

During use, the drainage blades 15 are immersed in water with the suction port of the drainage pump, and the agitation of the drainage blades 15 to the water will lift the water into the inner cavity of the impeller 10. In order to improve the drainage effect, the width of the drainage blade 15 in the direction of water flow is gradually increased, and the overall of the width of the drainage blade 15 is smoothly transited.

In an embodiment of the present application, four drainage blades 15 are further correspondingly arranged, and each of the four drainage blades 15 is fixedly connected with one long blade 12. In the embodiment, the four drainage blades 15 are further in a "cross" shape.

As shown in FIGS. 2 and 4, in an embodiment of the present application, the plate-shaped structure 131 is gradually inclined from the center to the outside in the direction towards the long blades 12. In the embodiment, a surface of the whole of the plate-shaped structure 131 is a smooth arc inclined surface, that is, the plate-shaped structure 131 extends obliquely from the center to the axis of the impeller shaft 11 in the direction towards the long blades 12.

Through the above arrangement, the plate-shaped structure forms a "funnel" structure as a whole, which can play a better role in pushing and guiding the water flow, prevent the water flow from falling back after lifting, and the water flow is lifted smoothly, which is conducive to reducing noise.

In an embodiment of the present application, in order to improve the mechanical strength of the impeller 10, the impeller 10 is formed into an integrated structure through the integrated molding process. For example, the impeller 10 can be a plastic part, and integrally molded by an injection molding process.

In an embodiment, the impeller is further made by other integrated molding. For example, the impeller can be made of metal parts, which can form an integrated structure through forging and other processes.

Figure 5:
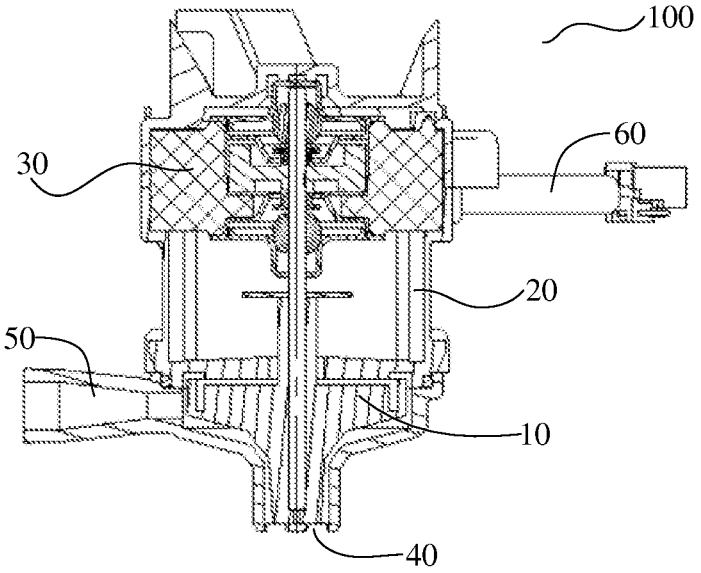
FIG. 5 is a schematic view of an overall structure of a drainage pump provided by an embodiment of the present application.

On the other hand, an embodiment of the present application further provides a drainage pump 100. The drainage pump 100 can be applied in an indoor unit of an air conditioner, a washing machine, a dishwasher and other electrical appliances with drainage requirements, which is not limited in the present application. FIG. 5 is the overall structural schematic view of the drainage pump 100 provided by an embodiment of the present application.

As shown in FIG. 5, the drainage pump 100 provided by an embodiment of the present application includes: the impeller 10 provided by the preceding embodiments, a pump housing 20, and a motor 30.

The inner part of the pump housing 20 forms an accommodating cavity, and the impeller and the motor 30 are arranged in the accommodating cavity. The impeller 10 is movably accommodated in the pump housing 20. The output shaft of the motor 30 is fixedly connected with the impeller shaft 11, which can drive the impeller 10 to rotate to generate suction.

In an embodiment, the pump housing 20 is made of plastic material, which is conducive to reducing the overall weight of the drainage pump.

In an embodiment, the pump housing 20 includes an upper pump housing and a lower pump housing. The upper pump housing and the lower pump housing form a detachable connection into an integral structure through screws, buckles, etc., thereby defining the accommodating cavity.

In an embodiment of the present application, the motor 30 is further arranged in the accommodating cavity.

In other embodiments, the motor 30 is arranged outside the accommodating cavity, and the output shaft of the motor extends into the accommodating cavity from the outside of the pump housing and is fixedly connected with the impeller shaft 11.

The pump housing 20 is respectively provided with a suction port 40 and a drainage port 50. The motor 30 drives the impeller 10 to rotate. Under the action of centrifugal force, the water is sucked into the pump housing 20 through the suction port 40, and then discharged through the drainage port 50.

As shown in FIG. 5, the drainage pump 100 further includes a power line 60, which is connected with the motor 30 to supply power to the motor 30.

In an embodiment, the motor 30 is a single-phase permanent magnet synchronous motor. In the embodiment, the motor 30 includes a stator, a rotor and a output shaft of the motor.

During the operation of the drainage pump 100, the stator drives the rotor to rotate, and drives the impeller 10 to rotate through the output shaft of the motor and the impeller shaft 11, the water is sucked into the pump housing 20 through the suction port 40, and finally the water is discharged through the drainage port 50. The present application optimizes the structure of impeller 10, the internal and external pressure difference of impeller 10 is balanced, the vibration generated during the operation of the impeller 10 is reduced, and the noise generated during the operation of the impeller 10 is reduced.

Since the drainage pump 100 uses the impeller 10 provided in the above embodiments, the drainage pump 100 further has the technical effect corresponding to the aforementioned impeller 10, which will not be repeated here.

Figure 6:
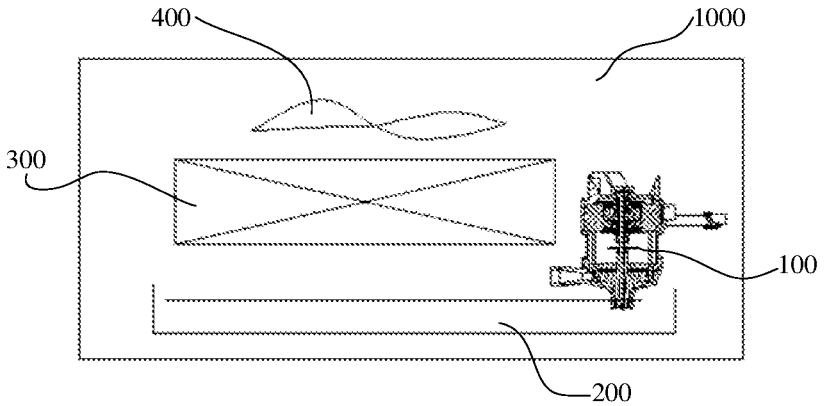
FIG. 6 is the structural schematic view of an indoor unit of an air conditioner provided by an embodiment of the present application.

In a further aspect, an embodiment of the present application further provides an indoor unit 1000 of an air conditioner. FIG. 6 is the structural schematic view of the indoor unit 1000 of the air conditioner provided by an embodiment of the present application.

As shown in FIG. 6, the indoor unit 1000 of the air conditioner provided by the embodiment of the present application includes the drainage pump 100 provided by the previous embodiment and a condensate tray 200. The suction port 40 of the drainage pump 100 is in communicated with the condensate tray 200, so that the condensed water gathered in the condensate tray 200 can be discharged.

The indoor unit 1000 of the air conditioner further includes an evaporator 300, and the condensate tray 200 is arranged below the evaporator 300 to collect the condensed water dripping from the surface of the evaporator 300. The condensate tray can also be referred to as ponding tray, collecting tray, etc.

In order to improve the effect of convective heat transfer, an indoor fan 400 is further arranged on one side of the evaporator 300.

In an embodiment, the indoor fan 400 is an EC fan. The EC fan has the advantages of energy saving, high efficiency, low vibration and low noise.

Since the indoor unit 1000 of the air conditioner adopts the impeller 10 provided in the above embodiment, the indoor unit 1000 of the air conditioner further has the technical effect corresponding to the aforementioned impeller 10, which will not be repeated here.

The above is only the specific implementation of the present application, but the scope of protection of the present application is not limited to this. Any technical personnel familiar with the technical field can easily think of changes or replacements within the scope of technology disclosed in the present application, which should be covered in the scope of protection of the present application. Therefore, the scope of protection of the present application shall be subject to the scope of protection of the claims.

What is claimed is:

1. An impeller comprising:

an impeller shaft;

a plurality of blades comprising long blades and short blades, the long blades being fixedly connected to the impeller shaft and extending outward along a radial direction of the impeller shaft; and a circular disc comprising a plate-shaped structure sleeved on an outer circumference of the impeller shaft and an annular structure fixedly connected with the outer edge of the plate-shaped structure, wherein the short blades are fixedly connected to the plate-shaped structure and spaced apart from the impeller shaft and the annular structure, wherein the long blades are spaced apart from the annular structure, wherein the plate-shaped structure is provided with a plurality of balance through holes between two adjacent long blades and communicating front and rear sides of the plate-shaped structure, wherein the plurality of balance through holes at least including a balance through hole circumferentially disposed between two adjacent short blades, and two balance through holes each circumferentially disposed between a different adjacent set of a long blade and a short blade, wherein each balance through hole being circumferentially disposed between two adjacent blades of the plurality of blades is spaced apart from the two adjacent blades and the annular structure, and wherein at least a portion of each balance through hole is disposed radially outward of the two adjacent blades.

2. The impeller according to claim 1, wherein:

the plurality of balance through holes are evenly arranged at an outer edge of the plate-shaped structure.

3. The impeller according to claim 2, wherein:

the annular structure is arranged at outer circumferences of the long blades, and a gap is formed between the annular structure and each of the long blades.

4. The impeller according to claim 3, wherein at least one of the short blades is arranged on the plate-shaped structure and located between two of the adjacent long blades.

5. The impeller according to claim 4, wherein a gap is formed between each of outer ends of the short blades and the annular structure.

6. The impeller according to claim 3, wherein a height of the annular structure is higher than a height of each of the long blades along an axial direction of the impeller shaft.

7. The impeller according to claim 1, wherein the plate-shaped structure extends gradually in an obliquely upward direction from a center to an outside in a direction towards the long blades.

8. The impeller according to claim 1, wherein the plate-shaped structure is fixedly connected with bottoms of the long blades.

9. The impeller according to claim 1, wherein:

an end of the impeller shaft facing away from the long blades is provided with drainage blades, the drainage blades are connected with the long blades one by one, and a length of each of the long blades in the radial direction of the impeller shaft is greater than a length of each of the drainage blades.

10. The impeller according to claim 1, wherein the impeller is integrally formed by an injection molding process.

11. The impeller according to claim 1, wherein at least one of the balance through holes is a round hole with an aperture in a range of 1.0~3.0 mm.

12. The impeller according to claim 2, wherein the plate-shaped structure is gradually inclined and increased from a center to an outside in a direction towards the long blades.

13. The impeller according to claim 2, wherein the plate-shaped structure is fixedly connected with bottoms of the long blades.

14. The impeller according to claim 2, wherein:

an end of the impeller shaft facing away from the long blades is provided with drainage blades;

the drainage blades are connected with the long blades one by one; and a length of each of the long blades in the radial direction of the impeller shaft is greater than a length of each of the drainage blades.

15. The impeller according to claim 2, wherein the impeller is integrally formed by an injection molding process.

16. The impeller according to claim 2, wherein each of the plurality of balance through holes is a round hole with an aperture in a range of 1.0~3.0 mm.

17. The impeller according to claim 4, wherein a height of the annular structure is higher than a height of each of the long blades along an axial direction of the impeller shaft.

18. A drainage pump comprising:

a pump housing;

a motor; and an impeller comprising:

an impeller shaft;

a plurality of blades comprising long blades and short blades, the long blades being fixedly connected to the impeller shaft and extending outward along a radial direction of the impeller shaft; and a circular disc comprising a plate-shaped structure sleeved on an outer circumference of the impeller shaft and an annular structure fixedly connected with the outer edge of the plate-shaped structure, wherein the short blades are fixedly connected to the plate-shaped structure and spaced apart from the impeller shaft and the annular structure, wherein the long blades are spaced apart from the annular structure, wherein the plate-shaped structure is provided with a plurality of balance through holes between two adjacent long blades and communicating front and rear sides of the plate-shaped structure, wherein the plurality of balance through holes at least including a balance through hole circumferentially disposed between two adjacent short blades, and two balance through holes each circumferentially disposed between a different adjacent set of a long blade and a short blade, wherein each balance through hole being circumferentially disposed between two adjacent blades of the plurality of blades is spaced apart from the two adjacent blades and the annular structure, wherein at least a portion of each balance through hole is disposed radially outward of the two adjacent blades, and wherein the impeller is movably accommodated in the pump housing, and an output shaft of the motor is fixedly connected with the impeller shaft.

19. An indoor unit of an air conditioner, comprising a condensate tray and a drainage pump, the drainage pump comprising:

a pump housing;

a motor; and an impeller comprising:

an impeller shaft;

a plurality of blades comprising long blades and short blades, the long blades being fixedly connected to the impeller shaft and extending outward along a radial direction of the impeller shaft; and a circular disc, comprising a plate-shaped structure sleeved on an outer circumference of the impeller shaft and an annular structure fixedly connected with the outer edge of the plate-shaped structure, wherein the short blades are fixedly connected to the plate-shaped structure and spaced apart from the impeller shaft and the annular structure, wherein the long blades are spaced apart from the annular structure, wherein the plate-shaped structure is provided with a plurality of balance through holes between two adjacent long blades and communicating front and rear sides of the plate-shaped structure, wherein the plurality of balance through holes at least including a balance through hole circumferentially disposed between two adjacent short blades, and two balance through holes each circumferentially disposed between a different adjacent set of a long blade and a short blade, wherein each balance through hole being circumferentially disposed between two adjacent blades of the plurality of blades is spaced apart from the two adjacent blades and the annular structure, and wherein at least a portion of each balance through hole is disposed radially outward of the two adjacent blades, wherein the impeller is movably accommodated in the pump housing, and an output shaft of the motor is fixedly connected with the impeller shaft, and wherein a suction port of the drainage pump is in communication with the condensate tray.

* * * * *